US009358816B2

(12) United States Patent
Yamagata et al.

(10) Patent No.: US 9,358,816 B2
(45) Date of Patent: Jun. 7, 2016

(54) PRINTER HAVING DUPLEX PRINTING FUNCTION

(71) Applicant: RISO KAGAKU CORPORATION, Tokyo (JP)

(72) Inventors: Akihiro Yamagata, Ibaraki (JP); Masashi Hara, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/918,140

(22) Filed: Oct. 20, 2015

(65) Prior Publication Data

US 2016/0114602 A1 Apr. 28, 2016

(30) Foreign Application Priority Data

Oct. 23, 2014 (JP) ..... 2014-216264

(51) Int. Cl.
*B41J 29/393* (2006.01)
*B41J 13/00* (2006.01)
*B41J 2/01* (2006.01)

(52) U.S. Cl.
CPC ..... *B41J 13/0009* (2013.01); *B41J 2/01* (2013.01)

(58) Field of Classification Search
CPC ..... B41J 11/663; B41J 11/0005; B41J 29/42; B41J 11/00; B41J 11/706; B41J 29/3935; B41J 2002/17569; B41J 11/42; B41J 11/008
See application file for complete search history.

(56) References Cited

U.S. PATENT DOCUMENTS 8,641,305 B2 * 2/2014 Yasuzaki ..... B41J 3/60 347/104
8,752,929 B2 * 6/2014 Arakane ..... B41J 23/04 347/16
8,827,407 B2 * 9/2014 Ogawa ..... B41J 13/0009 347/16

FOREIGN PATENT DOCUMENTS

JP 2012-126541 7/2012

* cited by examiner

*Primary Examiner* — Lamson Nguyen
(74) *Attorney, Agent, or Firm* — Hamre, Schumann, Mueller & Larson, P.C.

(57) ABSTRACT

Upon a misfeeding of any of second and subsequent sheets in paper feeding by a paper feeding unit during duplex printing, a controller drives the paper feeding unit to perform a paper feeding retry at one or more of paper feeding timings in a paper feeding schedule for duplex printing. The paper feeding schedule for duplex printing specifies the paper feeding timings by the paper feeding unit and paper refeeding timings by a paper refeeding unit for a case other than the misfeeding of any of the second and subsequent sheets in the paper feeding by the paper feeding unit such that the sheet refed from the paper refeeding unit and the sheet fed from the paper feeding unit are alternately conveyed to a printing unit.

9 Claims, 10 Drawing Sheets

PRINTER HAVING DUPLEX PRINTING FUNCTION

CROSS REFERENCE TO RELATED APPLICATION

This application is based upon and claims the benefit of priority from the prior Japanese Patent Application No. 2014-216264, filed on Oct. 23, 2014, the entire contents of which are incorporated herein by reference.

BACKGROUND

1. Technical Field

The discloser relates to a printer configured to perform printing on sheets.

2. Related Art

A printer which picks up sheets from a paper feed tray by using a roller and feeds the sheets to a printing unit is known. In such a printer, misfeeding of a sheet (failure of feeding) sometimes occurs due to slipping of the roller.

When the misfeeding occurs, the printer determines that jam has occurred and stops its operation. In this case, the user needs to perform work of jam release and error clearing. Moreover, a period in which the operation of the printer is stopped is a downtime, and the productivity of printed matters decreases.

Japanese Unexamined Patent Application Publication No. 2012-126541 discloses a technique in which paper feeding is retried when misfeeding occurs in paper feeding. When the sheet can be fed by retrying the paper feeding, there is no need to stop the printer due to jam. Accordingly, the user does not have to perform the work of jam release and error clearing and the usability is improved. Moreover, since there is no downtime, a decrease in the productivity of printed matters can be suppressed.

SUMMARY

There is a printer which has a circulation route including a switchback route and which performs duplex printing in the following way. Sheets printed on front sides are turned over by being circularly conveyed along the circulation route, then are refed to a printing unit, and are printed on back sides.

An interleaving method is known as a duplex printing method used in such a printer. The interleaving method is a method in which front sides of unprinted sheets and back sides of sheets printed on the front sides are alternately printed while multiple sheets are circularly conveyed. In the interleaving method, a schedule of paper feeding timings of the unprinted sheets and the paper refeeding timings of the sheets printed on the front sides is managed such that the paper feeding of the unprinted sheets and the paper refeeding of the sheets printed on the front sides are performed alternately.

The technique of Japanese Unexamined Patent Application Publication No. 2012-126541 does not manage timings of paper feeding retry due to occurrence of misfeeding, and cannot deal with the case where the schedule management of the paper feeding timings and the paper refeeding timings is required as described above.

An object of the present invention is to provide a printer which manages a schedule of paper feeding timings and paper refeeding timings in the duplex printing and which can improve usability for a user and suppress a decrease in productivity of printed matters.

A printer in accordance with some embodiments includes: a printing unit configured to perform printing while conveying a sheet; a paper feeding unit configured to feed the sheet to the printing unit; a circulation conveying unit including a route and configured to convey the sheet sent out from the printing unit along the route, the route including a switchback route for turning over the sheet; a paper refeeding unit configured to refeed the sheet turned over in the switchback route to the printing unit; and a controller configured to control a paper feeding by the paper feeding unit and a paper refeeding by the paper refeeding unit based on a paper feeding schedule for duplex printing which specifies paper feeding timings by the paper feeding unit and paper refeeding timings by the paper refeeding unit for a case other than a misfeeding of any of second and subsequent sheets in the paper feeding by the paper feeding unit such that the sheet refed from the paper refeeding unit and the sheet fed from the paper feeding unit are alternately conveyed to the printing unit. Upon the misfeeding of any of the second and subsequent sheets in the paper feeding by the paper feeding unit during the duplex printing, the controller drives the paper feeding unit to perform a paper feeding retry at one or more of the paper feeding timings in the paper feeding schedule for duplex printing.

In the configuration described above, the paper feeding retry can be performed not to overlap the paper refeeding by the paper refeeding unit in the duplex printing. Moreover, when the paper feeding is achieved in the paper feeding retry, stopping of the printer due to jam is unnecessary. Accordingly, the work of jam release and error clearing due to misfeeding is reduced, and the usability for the user is improved. Moreover, since the occurrence of downtime due to stopping of the printer is reduced, a decrease in the productivity of printed matters can be suppressed.

Accordingly, in the printer configured to manage the schedule of the paper feeding timings and the paper refeeding timings in the duplex printing, the frequency of the printer being stopped due to occurrence of the misfeeding can be reduced, thereby improving the usability for the user and suppressing the decrease in the productivity of printed matters.

Upon the misfeeding of any of the second and subsequent sheets in the paper feeding by the paper feeding unit during the duplex printing, the controller may drive the paper refeeding unit to refeed the sheet which has been already fed by the paper feeding unit and has not been refed for back side printing by the paper refeeding unit by a time point of the misfeeding, drive the circulation conveying unit to convey and turnover the refed sheet without the back side printing being performed, drive the paper refeeding unit to perform the paper refeeding at the paper feeding timing in the paper feeding schedule for duplex printing, and drive the paper feeding unit to perform the paper feeding retry at the paper feeding timing subsequent to the paper feeding timing of the sheet refed last.

In the configuration described above, the paper feeding retry can be performed not to overlap the paper refeeding by the paper refeeding unit in the duplex printing with the page printing order being maintained. Moreover, when the paper feeding is achieved in the paper feeding retry, stopping of the printer due to jam is unnecessary. Accordingly, the work of jam release and error clearing due to misfeeding is reduced, and the usability for the user is improved. Moreover, since the occurrence of downtime due to stopping of the printer is reduced, the decrease in the productivity of printed matters can be suppressed.

Accordingly, in the printer configured to manage the schedule of the paper feeding timings and the paper refeeding timings in the duplex printing, the frequency of the printer being stopped due to occurrence of the misfeeding can be reduced with the page printing order being maintained, thereby improving the usability for the user and suppressing the decrease in the productivity of printed matters.

Upon a misfeeding of the sheet in the paper feeding retry by the paper feeding unit, the controller may drive the paper feeding unit to repeat the paper feeding retry every paper feeding timing and stop performing the paper feeding retry when a number of times the misfeeding is repeated reaches a specified number.

The configuration described above can increase an opportunity in which the misfeeding is solved by the paper feeding retry and the paper feeding is resumed, while suppressing unnecessary repeating of the paper feeding retry.

The paper feeding unit may include: a paper feeding roller configured to pick up the sheet from a paper feed tray; and an intermediate conveying roller configured to send out the sheet picked up from the paper feed tray by the paper feeding roller to the printing unit. In the paper feeding retry of any of the second and subsequent sheets by the paper feeding unit, the controller may drive the paper feeding unit to keep the sheet picked up from the paper feed tray by the paper feeding roller waiting at the intermediate roller and then send the sheet to the printing unit by the intermediate conveying roller.

The configuration described above enables adjustment of the paper feeding timing in the paper feeding retry, only by using the intermediate conveying roller. Accordingly, shifting of the paper feeding timing can be suppressed.

Upon the misfeeding of any of the second and subsequent sheets in the paper feeding by the paper feeding unit during the duplex printing, the controller may drive the paper feeding unit to perform the paper feeding retry at the paper feeding timing subsequent to the paper feeding timing at an occurrence of the misfeeding in the paper feeding schedule for duplex printing.

The printing unit may include an inkjet head, the paper feeding unit may include a first roller, and the paper refeeding unit may include a second roller.

DETAILED DESCRIPTION

Figure 1:
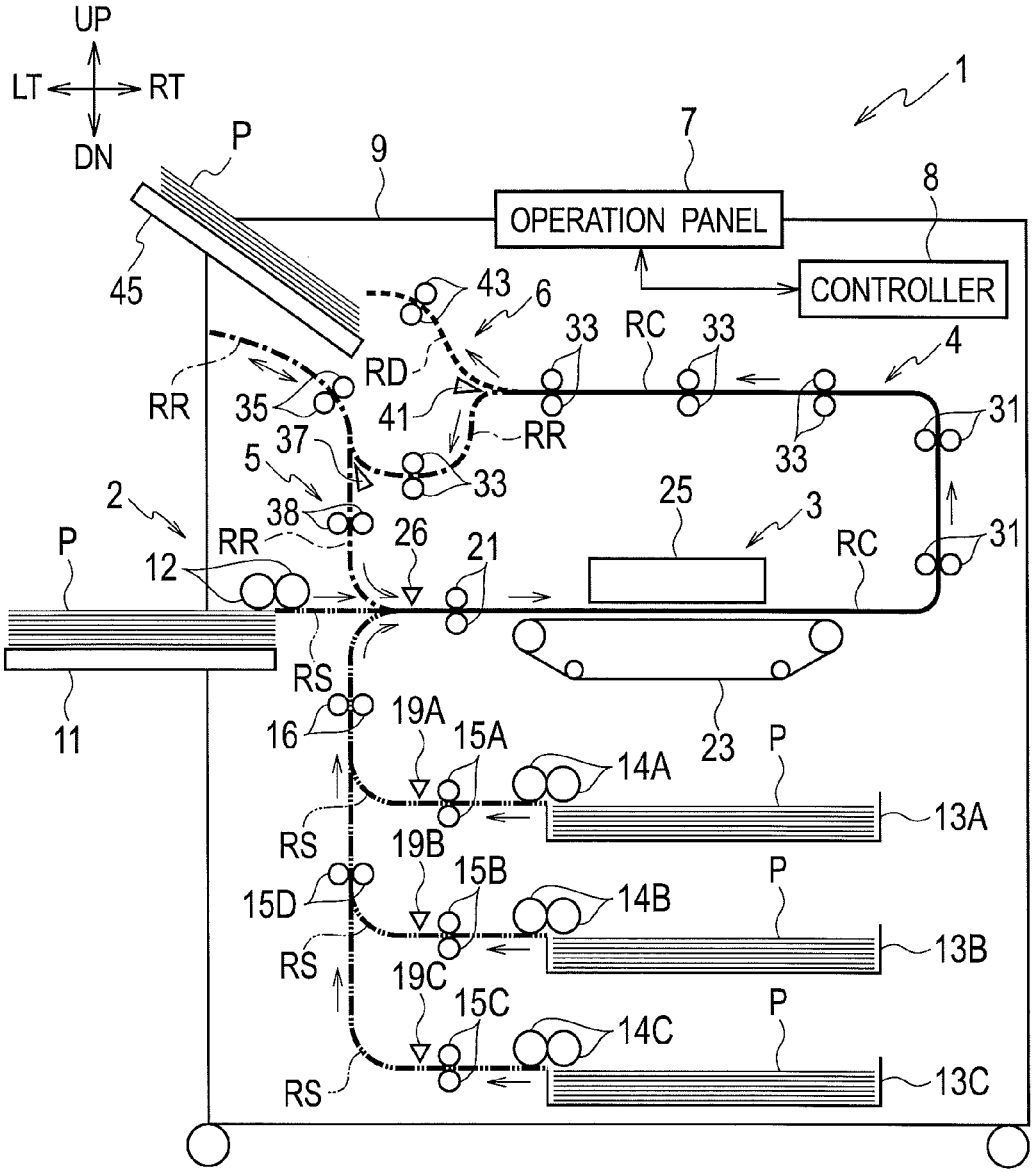
FIG. 1 is a schematic configuration diagram of a printer in a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

First Embodiment

Figure 2:
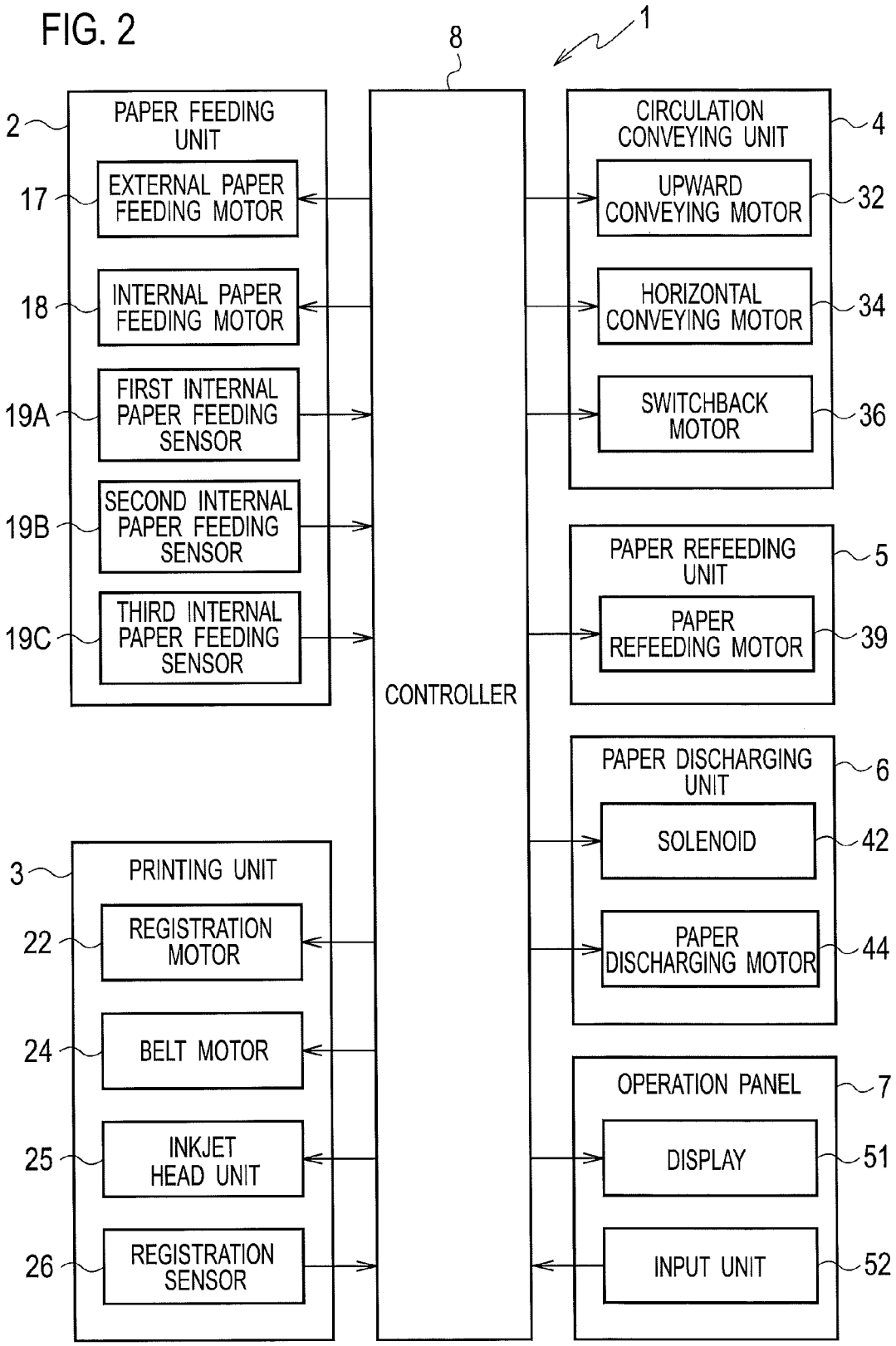
FIG. 2 is a control block diagram of the printer illustrated in FIG. 1.

FIG. 1 is a schematic configuration diagram of a printer in a first embodiment of the present invention. FIG. 2 is a control block diagram of the printer illustrated in FIG. 1. In the following description, directions orthogonal to the sheet surface of FIG. 1 are referred to as front-rear directions, and a direction toward the front side of the sheet is referred to as front. Moreover, in FIG. 1, directions of right, left, up, and down are denoted by RT, LT, UP, and DN, respectively.

A route illustrated by bold lines in FIG. 1 is a conveying route through which sheets being print media are conveyed. In the conveying route, a route illustrated by a solid line is a common route RC, a route illustrated by a one-dot chain line is a paper switchback refeeding route RR, a route illustrated by a broken line is a paper discharging route RD, and a route illustrated by a two-dot chain line is a paper feeding route RS. In the following description, upstream and downstream mean upstream and downstream in the conveying route.

As illustrated in FIGS. 1 and 2, a printer 1 of a first embodiment includes a paper feeding unit 2, a printing unit 3, a circulation conveying unit 4, a paper refeeding unit 5, a paper discharging unit 6, an operation panel 7, a controller 8, and a chassis 9 configured to house or hold the aforementioned units.

The paper feeding unit 2 feeds sheets P to the printing unit 3. The paper feeding unit 2 is disposed upstream of all the other units in the conveying route. The paper feeding unit 2 includes an external paper feed tray (paper feed tray) 11, external paper feeding rollers (paper feeding rollers) 12, first to third internal paper feed trays (paper feed trays) 13A to 13C, first to third internal paper feeding rollers (paper feeding rollers) 14A to 14C, first to fourth internal paper feeding conveying rollers 15A to 15D, intermediate conveying rollers 16, an external paper feeding motor 17, an internal paper feeding motor 18, and first to third internal paper feeding sensors 19A to 19C.

The external paper feed tray 11 is a tray on which the sheets P used for printing are stacked. Part of the external paper feed tray 11 is installed to be exposed to the outside of the chassis 9.

The external paper feeding rollers 12 pick up the sheets P stacked on the external paper feed tray 11 one by one, and convey the sheets P along the paper feeding route RS toward registration rollers 21 to be described later.

The first to third internal paper feed trays 13A to 13C are trays on which the sheets P used for the printing are stacked. The first to third internal paper feed trays 13A to 13C are disposed inside the chassis 9. The second internal paper feed tray 13B is disposed below the first internal paper feed tray 13A, and the third internal paper feed tray 13C is disposed below the second internal paper feed tray 13B.

The pairs of first to third internal paper feeding rollers 14A to 14C pick up the sheets P stacked on the first to third internal paper feed trays 13A to 13C one by one, respectively.

The first internal paper feeding conveying rollers 15A convey the sheets P taken out from the first internal paper feed tray 13A by the first internal paper feeding rollers 14A, toward the intermediate conveying rollers 16 along the paper feeding route RS. The second internal paper feeding conveying rollers 15B convey the sheets P taken out from the second internal paper feed tray 13B by the second internal paper feeding rollers 14B, toward the fourth internal paper feeding conveying rollers 15D along the paper feeding route RS. The third internal paper feeding conveying rollers 15C convey the sheets P taken out from the third internal paper feed tray 13C by the third internal paper feeding rollers 14C, toward the fourth internal paper feeding conveying rollers 15D along the paper feeding route RS. The fourth internal paper feeding conveying rollers 15D convey the sheets P conveyed by the second internal paper feeding conveying rollers 15B or the third internal paper feeding conveying rollers 15C, toward the intermediate conveying rollers 16 along the paper feeding route RS.

The intermediate conveying rollers 16 convey the sheets P conveyed by the first internal paper feeding conveying rollers 15A or the fourth internal paper feeding conveying rollers 15D, toward the registration rollers 21 to be described later.

The external paper feeding motor 17 rotationally drives the external paper feeding rollers 12 and the intermediate conveying rollers 16. The external paper feeding motor 17 is connected to each of the external paper feeding rollers 12 and the intermediate conveying rollers 16 via a not-illustrated one-way clutch. Thus, the external paper feeding rollers 12 are rotationally driven by rotation drive of the external paper feeding motor 17 in one direction, whereas the intermediate conveying rollers 16 are rotationally driven by rotation drive of the external paper feeding motor 17 in the other direction.

The internal paper feeding motor 18 rotationally drives the first to third internal paper feeding rollers 14A to 14C and the first to fourth internal paper feeding conveying rollers 15A to 15D. The internal paper feeding motor 18 can be connected to and disconnected from the first to third internal paper feeding rollers 14A to 14C and the first to fourth internal paper feeding conveying rollers 15A to 15D, via not-illustrated clutches. The clutches can switch the rollers to be rotationally driven out of the first to third internal paper feeding rollers 14A to 14C and the first to fourth internal paper feeding conveying rollers 15A to 15D.

The first to third internal paper feeding sensors 19A to 19C detect the sheets P in the paper feeding route RS near positions downstream of the first to third internal paper feeding conveying rollers 15A to 15C, respectively.

The printing unit 3 prints images on the sheets P while conveying the sheets P fed by the paper feeding unit 2. The printing unit 3 is disposed downstream of the paper feeding unit 2. The printing unit 3 includes the registration rollers 21, a registration motor 22, a belt conveying unit 23, a belt motor 24, an inkjet head unit 25, and a registration sensor 26.

The registration rollers 21 temporarily stop each of the sheets P conveyed from the paper feeding unit 2 or the paper refeeding unit 5 to perform skewing correction and then convey the sheet P toward the belt conveying unit 23. The registration rollers 21 are disposed in the common route RC near a point where the paper feeding route RS and the paper switchback refeeding route RR merge.

The registration motor 22 rotationally drives the registration rollers 21.

The belt conveying unit 23 conveys the sheets P conveyed by the registration rollers 21 while sucking and holding the sheets P on a belt. The belt conveying unit 23 is disposed downstream of the registration rollers 21.

The belt motor 24 drives the belt conveying unit 23.

The inkjet head unit 25 has multiple line-type inkjet heads (not illustrated) in each of which multiple nozzles are arranged in a direction orthogonal to the conveying direction of the sheets P (front-rear directions). The inkjet head unit 25 is disposed above the belt conveying unit 23. The inkjet head unit 25 prints an image by ejecting inks from the inkjet heads onto the sheets P conveyed by the belt conveying unit 23.

The registration sensor 26 detects the conveyed sheets P near a position upstream of the registration rollers 21.

The circulation conveying unit 4 conveys the sheets P sent out from the printing unit 3, to the paper refeeding unit 5 along the common route RC and the paper switchback refeeding route RR. The circulation conveying unit 4 includes multiple pairs of upward conveying rollers 31, an upward conveying motor 32, multiple pairs of horizontal conveying rollers 33, a horizontal conveying motor 34, switchback rollers 35, a switchback motor 36, and a switching gate 37.

The upward conveying rollers 31 convey the sheets P conveyed by the belt conveying unit 23, to the horizontal conveying rollers 33 thereabove. The upward conveying rollers 31 are disposed in an upward conveying portion in a midstream section of the common route RC.

The upward conveying motor 32 rotationally drives the upward conveying rollers 31.

The horizontal conveying rollers 33 convey the sheets P conveyed by the upward conveying rollers 31, to the switchback rollers 35. The most downstream pair of horizontal conveying rollers 33 is disposed in an upstream section of the paper switchback refeeding route RR. The other horizontal conveying rollers 33 are disposed in a horizontal portion in a downstream section of the common route RC.

The horizontal conveying motor 34 rotationally drives the horizontal conveying rollers 33.

The switchback rollers 35 switch back the sheets P conveyed by the horizontal conveying rollers 33 and convey the sheets P to paper refeeding rollers 38 to be described later. The switchback rollers 35 are disposed downstream of the most downstream pair of horizontal conveying rollers 33, in the paper switchback refeeding route RR. A portion where the sheets P are switched back in the paper switchback refeeding route RR corresponds to a switchback route.

The switchback motor 36 rotationally drives the switchback rollers 35.

The switching gate 37 guides the sheets P conveyed by the horizontal conveying rollers 33 to the switchback rollers 35. Moreover, the switching gate 37 guides the sheets P switched back by the switchback rollers 35 to the paper refeeding rollers 38 to be described later. The switching gate 37 is disposed near a center of mass of three portions of the most downstream pair of horizontal conveying rollers 33, the pair of switchback rollers 35, and the pair of paper refeeding rollers 38.

The paper refeeding unit 5 refeeds the sheets turned over by being switched back by the switchback rollers 35, to the printing unit 3. The paper refeeding unit 5 includes the paper refeeding rollers 38 and a paper refeeding motor 39.

The paper refeeding rollers 38 convey the sheets P conveyed by the switchback rollers 35, to the registration rollers 21. The paper refeeding rollers 38 are disposed between the pair of switchback rollers 35 and the pair of registration rollers 21 in the paper switchback refeeding route RR.

The paper refeeding motor 39 rotationally drives the paper refeeding rollers 38.

The paper discharging unit 6 delivers the printed sheets P. The paper discharging unit 6 includes a switching unit 41, a solenoid 42, paper discharging rollers 43, a paper discharging motor 44, and a paper receiving tray 45.

The switching unit 41 switches the conveying route of the sheets P from the paper discharging route RD to the paper switchback refeeding route RR and vice versa. The switching unit 41 is disposed at a branching point between the paper discharging route RD and the paper switchback refeeding route RR.

The solenoid 42 drives the switching unit 41.

The paper discharging rollers 43 convey the sheets P guided to the paper discharging route RD by the switching unit 41 and deliver the sheets P to the paper receiving tray 45. The paper discharging rollers 43 are disposed in the paper discharging route RD between the switching unit 41 and the paper receiving tray 45.

The paper discharging motor 44 rotationally drives the paper discharging rollers 43.

The paper receiving tray 45 is a tray on which the delivered sheets P are stacked. The paper receiving tray 45 is disposed at a downstream end of the paper discharging route RD.

The operation panel 7 displays various types of input screens and the like and receives input operations made by a user. The operation panel 7 includes a display 51 and an input unit 52.

The display 51 displays images of the various types of input screens and the like. The display 51 has a liquid crystal display panel and the like.

The input unit 52 receives the input operations made by the user and outputs operation signals corresponding to the operation. The input unit 52 has various types of operation keys, a touch panel, and the like.

The controller 8 controls operations of the units in the printer 1. The controller 8 includes a CPU, a RAM, a ROM, a hard disk drive, and the like.

In simplex printing, the controller 8 controls the paper feeding unit 2 to perform paper feeding based on a paper feeding schedule for simplex printing. The controller 8 performs control such that the printing unit 3 performs printing on the fed sheets P, the circulation conveying unit 4 conveys the printed sheets P, and the paper discharging unit 6 delivers the sheets P.

The paper feeding schedule for simplex printing defines paper feeding timings of the paper feeding unit 2 such that an unprinted sheet P is fed for every operation of the registration rollers 21 by which the sheet P is sent out to the belt conveying unit 23 to be printed while being conveyed at a predetermined sheet interval. The sheet interval is a distance between a trailing edge of a preceding sheet P and a leading edge of a subsequent sheet P.

In duplex printing, the controller 8 drives the circulation conveying unit 4 to convey and turn over the sheets P printed on front sides, drives the paper refeeding unit 5 to refeed the sheets P to the printing unit 3, and drives the printing unit 3 to perform back side printing. In the duplex printing in which such refeeding is performed, the controller 8 performs control such that the paper feeding by the paper feeding unit 2 and the paper refeeding by the paper refeeding unit 5 are performed based on a paper feeding schedule for duplex printing. Here, a side printed first in each sheet P is referred to as front side, while the opposite side to the front side is referred to as back side.

The paper feeding schedule for duplex printing defines paper feeding timings of the paper feeding unit 2 and the paper refeeding timings of the paper refeeding unit 5 such that the sheets P which are printed on the front sides and refed from the paper refeeding unit 5 and the unprinted sheets P which are fed from the paper feeding unit 2 are alternately conveyed to the printing unit 3. Here, the registration rollers 21 operate to alternately send out the paper sheets P fed from the paper feeding unit 2 and the paper sheets P refed from the paper refeeding unit 5, to the belt conveying unit 23 at sheet intervals similar to those in the simplex printing. The paper feeding schedule for duplex printing is set such that the sheet P is fed or refed for every operation of the registration rollers 21. The productivity for one side in the duplex printing is thereby substantially the same as that in the simplex printing.

When misfeeding of the sheet P occurs in the paper feeding of the first sheet in the paper feeding unit 2, the controller 8 performs control such that the paper feeding unit 2 performs paper feeding retry of feeding the sheet again, at an arbitrary timing. When the paper feeding unit 2 causes misfeeding of any of the second and subsequent sheets P in the paper feeding, the controller 8 performs control such that the paper feeding retry is performed at a certain paper feeding timing in the paper feeding schedule, for example, at the next paper feeding timing.

Next, operations of the printer 1 are described.

First, operations of the printer 1 in the simplex printing are described.

Figure 3:
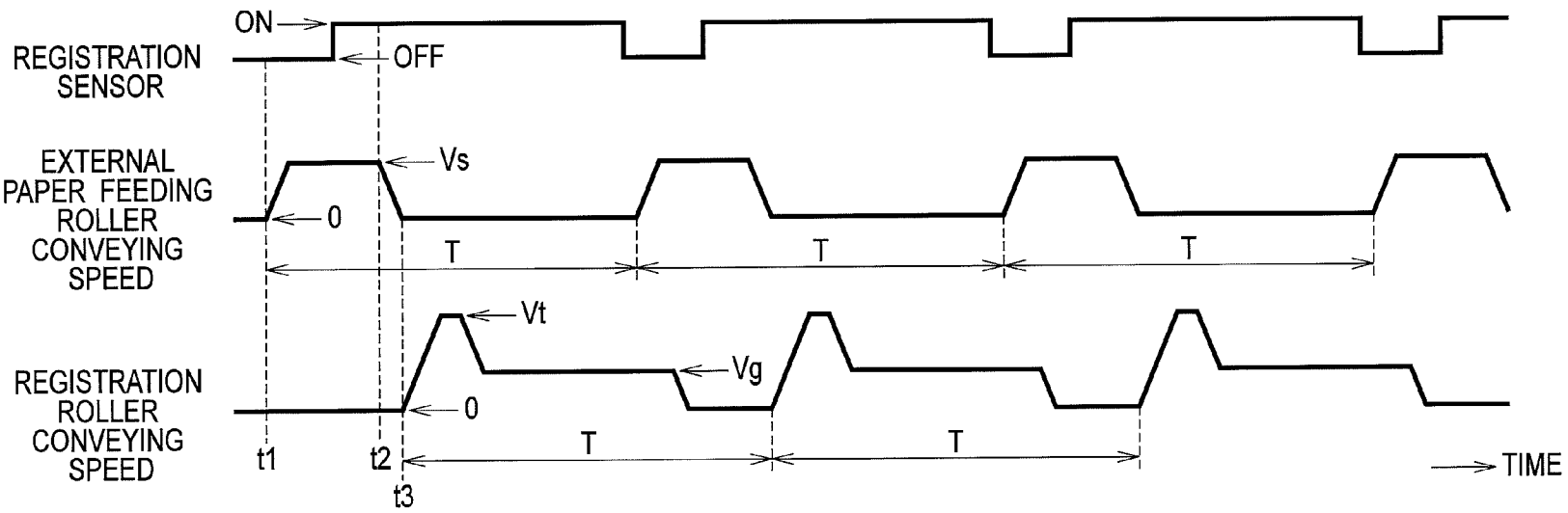
FIG. 3 is an explanatory view of operations of external paper feeding rollers and registration rollers in simplex printing in which sheets are fed from an external paper feed tray.

When the sheets are fed from the external paper feed tray 11, as shown FIG. 3, the controller 8 activates the external paper feeding motor 17 to start the drive of the external paper feeding rollers 12 at a time point t1 before the start of the drive of the registration rollers 21. When the speed of conveyance by the external paper feeding rollers 12 reaches a predetermined conveying speed Vs, the controller 8 performs control such that the external paper feeding rollers 12 maintain the conveying speed Vs for a predetermined time, then start to decelerate at a time point t2, and stop at a time point t3. In a drive period from the time point t1 to the time point t3, the external paper feeding rollers 12 pick up the sheet P from the external paper feed tray 11 and cause the sheet P to abut on the registration rollers 21 to form a predetermined amount of sag in the sheet P.

Moreover, at the time point t3, the controller 8 activates the registration motor 22 to start the drive of the registration rollers 21. When the speed of conveyance by the registration rollers 21 reaches a predetermined conveying speed Vt, the controller 8 drives the registration rollers 21 to maintain the conveying speed Vt for a predetermined time and then decelerate to a print conveying speed Vg. The print conveying speed Vg is equal to the speed of conveyance by the belt conveying unit 23. The controller 8 performs control such that the registration rollers 21 maintain the print conveying speed Vg and stop when the trailing edge of the sheet P passes the registration rollers 21.

Figure 4:
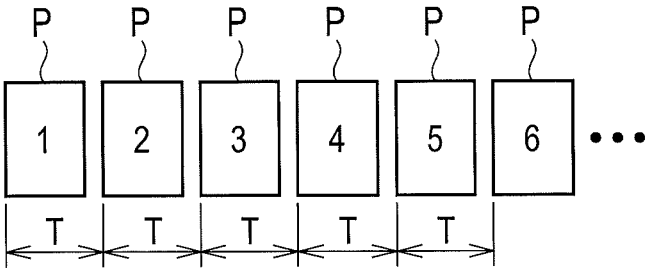
FIG. 4 is an explanatory view of a paper feeding schedule in the simplex printing.

As shown in FIG. 3, the controller 8 drives the external paper feeding rollers 12 to operate as described above at a cycle of print time T, based on the paper feeding schedule for simplex printing. The sheets P are thereby fed at the cycle of print time T as shown in FIG. 4. In FIG. 4, the numbers inside the sheets P indicate the order of the sheets.

As shown in FIG. 3, the paper feed timings are defined in accordance with the aforementioned operation of the registration rollers 21 at the cycle of the print time T. The print time T is a value obtained by adding a predetermined sheet interval to the length of the sheet P in the conveying direction and dividing the resultant distance with the print conveying speed Vg. By causing the registration rollers 21 to operate at the cycle of print time T, the sheets P are sent out to the belt conveying unit 23 to be conveyed and printed at the predetermined sheet intervals.

The sheets P sent out to the belt conveying unit 23 are printed by the inkjet head unit 25 while being conveyed by the belt conveying unit 23. The printed sheets P are conveyed by the upward conveying rollers 31 and the horizontal conveying rollers 33 in the circulation conveying unit 4, and are guided to the paper discharging route RD by the switching unit 41 of the paper discharging unit 6. Then, the sheets P are delivered to the paper receiving tray 45 by the paper discharging rollers 43.

Next, description is given of cases where the sheets are fed from the first to third internal paper feed trays 13A to 13C. For example, in the case where the sheets are fed from the first internal paper feed tray 13A, the controller 8 connects the first internal paper feeding rollers 14A and the first internal paper feeding conveying rollers 15A to the internal paper feeding motor 18 by using the clutch. Then, the controller 8 activates the internal paper feeding motor 18. This causes the first internal paper feeding rollers 14A to pick up the sheet P from the first internal paper feed tray 13A and causes the first internal paper feeding rollers 14A and the first internal paper feeding conveying rollers 15A to convey the sheet P to the intermediate conveying rollers 16.

Before the sheet P reaches the intermediate conveying rollers 16, the controller 8 activates the external paper feeding motor 17 to start the drive of the intermediate conveying rollers 16. When the speed of conveyance by the intermediate conveying rollers 16 reaches a predetermined conveying speed, the controller 8 drives the intermediate conveying rollers 16 to maintain the predetermined conveying speed for a predetermined time and then stop. In this drive period, the intermediate conveying rollers 16 receive the sheet P, convey the sheet P to the registration rollers 21, and cause the sheet P to abut on the registration rollers 21 to form a predetermined amount of sag.

Then, the controller 8 drives the registration motor 22 to drive the registration rollers 21 as in the aforementioned case where the sheet is fed from the external paper feed tray 11.

The controller 8 controls the drive of the first internal paper feeding rollers 14A, the first internal paper feeding conveying rollers 15A, and the intermediate conveying rollers 16 such that the sheets are fed at the cycle of print time T, based on the paper feeding schedule for simplex printing. The sheets P are thereby fed at the cycle of print time T as shown in FIG. 4 and printed by the printing unit 3 as in the aforementioned case of feeding the sheets from the external paper feed tray 11. Then, the printed sheets P are delivered to the paper receiving tray 45 in the paper discharging unit 6.

In the paper feeding unit 2, misfeeding of the sheet P sometimes occurs due to slipping of the external paper feeding rollers 12 or the first to third internal paper feeding rollers 14A to 14C. Description is given of paper feeding operations by the paper feeding unit 2 which include measures taken when the misfeeding occurs.

Figure 5:
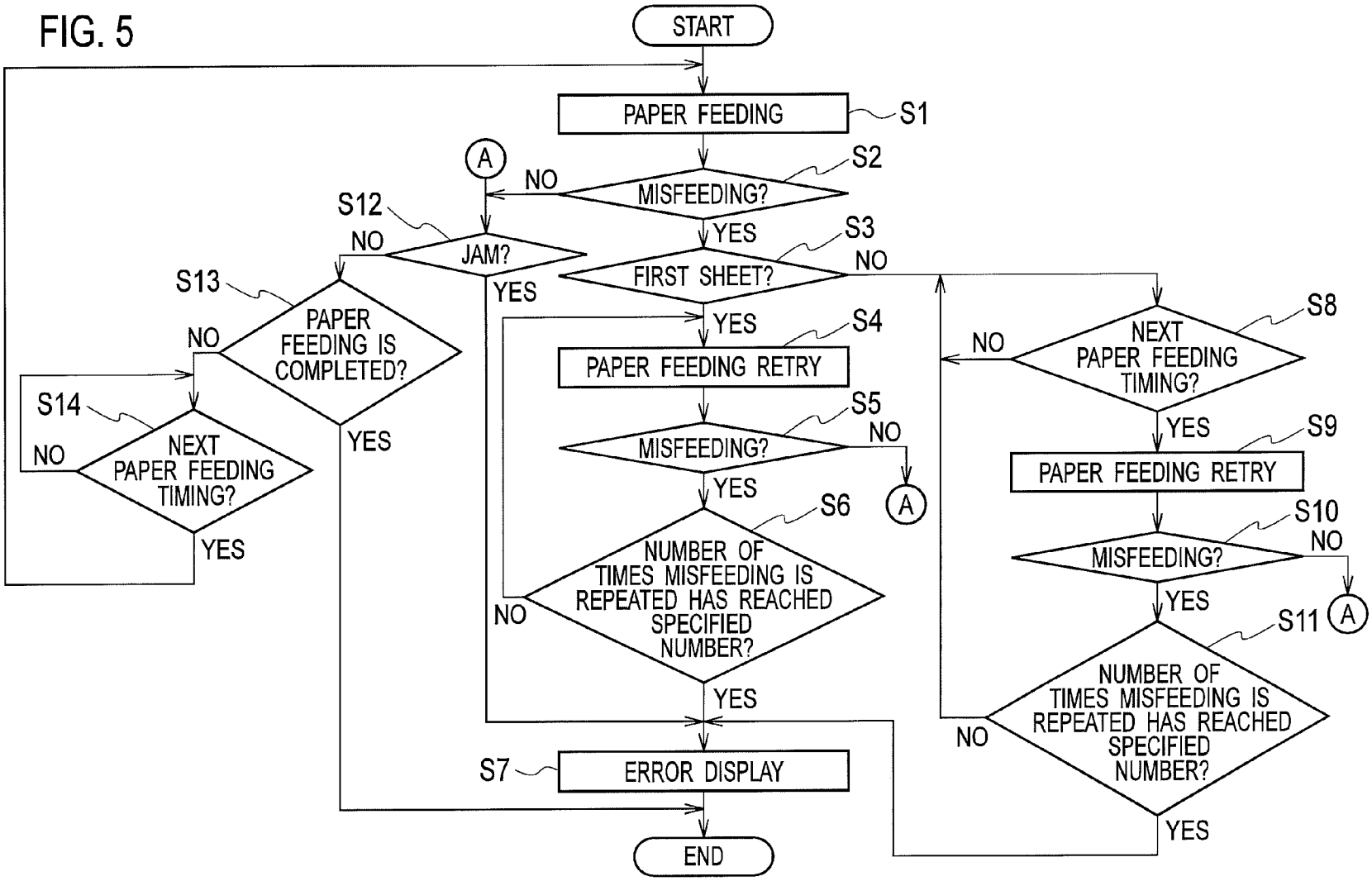
FIG. 5 is a flowchart for explaining a paper feeding operation by a paper feeding unit in the first embodiment.

FIG. 5 is a flowchart for explaining the paper feeding operation performed by the paper feeding unit 2 in the first embodiment. Processing of the flowchart of FIG. 5 starts when an instruction of print start is given.

In step S1 of FIG. 5, the controller 8 controls the paper feeding unit 2 such that one sheet P is fed from any one of the external paper feed tray 11 and the first to third internal paper feed trays 13A to 13C.

Next, in step S2, the controller 8 determines whether or not the misfeeding has occurred in the paper feeding unit 2.

In this case, when the sheet is fed from the external paper feed tray 11, the controller 8 determines whether or not the misfeeding or jam has occurred, by using the registration sensor 26.

Specifically, when the registration sensor 26 turns on in a period from the drive start of the external paper feeding rollers 12 to the timing (time point t2) of the start of deceleration for stopping the external paper feeding rollers 12 as shown in FIG. 3, the controller 8 determines that no misfeeding or jam has occurred. Note that a state where the registration sensor 26 detects the sheet P is referred to as on, while a state where the registration sensor 26 does not detect the sheet P is referred to as off.

Meanwhile, when the registration sensor 26 does not turn on before the timing (time point t2) of the start of deceleration for stopping the external paper feeding rollers 12, the controller 8 determines that the misfeeding or jam has occurred. When determining that the misfeeding or jam has occurred, the controller 8 stops the external paper feeding rollers 12.

When the registration sensor 26 is off at the time point where the external paper feeding rollers 12 are stopped, the controller 8 determines that the misfeeding has occurred. When the registration sensor 26 is on at the time point where the external paper feeding rollers 12 are stopped, the controller 8 determines that the jam has occurred.

When the sheets are fed from the first to third internal paper feed trays 13A to 13C, the controller 8 determines whether or not the misfeeding or jam has occurred by using the first to third internal paper feeding sensors 19A to 19C.

For example, description is given of a case where the sheet is fed from the first internal paper feed tray 13A. When the first internal paper feeding sensor 19A does not turn on before a predetermined time elapses from the drive start of the first internal paper feeding rollers 14A and the first internal paper feeding conveying rollers 15A, the controller 8 determines that the misfeeding or jam has occurred. When determining that the misfeeding or jam has occurred, the controller 8 stops the first internal paper feeding rollers 14A and the first internal paper feeding conveying rollers 15A.

When the first internal paper feeding sensor 19A is off at the time point where the first internal paper feeding rollers 14A and the first internal paper feeding conveying rollers 15A are stopped, the controller 8 determines that the misfeeding has occurred. When the first internal paper feeding sensor 19A is on at the time point where the first internal paper feeding rollers 14A and the first internal paper feeding conveying rollers 15A are stopped, the controller 8 determines that the jam has occurred.

When the controller 8 determines in step S2 of FIG. 5 that the misfeeding has occurred (step S2: YES), the controller 8 determines in step S3 whether or not the current paper feeding is the paper feeding of the first sheet out of the specified number of sheets to be printed.

When the controller 8 determines that this paper feeding is the paper feeding of the first sheet (step S3: YES), in step S4, the controller 8 drives the paper feeding unit 2 to perform the paper feeding retry of feeding the sheet again, at an arbitrary timing.

Next, in step S5, the controller 8 determines whether or not the misfeeding has occurred in the paper feeding retry.

When the controller 8 determines that the misfeeding has occurred (step S5: YES), in step S6, the controller 8 determines whether or not the number of times the misfeeding is repeated has reached a specified number.

When the controller 8 determines that the number of times the misfeeding is repeated has not reached the specified number (step S6: NO), the controller 8 drives the processing to return to step S4.

When the controller 8 determines that the number of times the misfeeding is repeated has reached the specified number (step S6: YES), the controller 8 determines that a jam error has occurred and displays error on the display 51 in step S7. The controller 8 then terminates the paper feeding operation.

When the controller 8 determines in step S3 that this paper feeding is the paper feeding of any of the second and subsequent sheets (step S3: NO), the controller 8 determines in step S8 whether or not it is the next paper feeding timing in the paper feeding schedule. When the controller 8 determines that it is not the next paper feeding timing (step S8: NO), the controller 8 repeats step S8.

When the controller 8 determines that it is the next paper feeding timing in the paper feeding schedule (step S8: YES), the controller 8 performs the paper feeding retry in step S9.

Then, in step S10, the controller 8 determines whether or not the misfeeding has occurred in the paper feeding retry.

When the controller 8 determines that the misfeeding has occurred (step S10: YES), the controller 8 determines in step S11 whether or not the number of times the misfeeding is repeated has reached a specified number.

When the controller 8 determines that the number of times the misfeeding is repeated has not reached the specified number (step S11: NO), the controller 8 drives the processing to return to step S8. When the controller 8 determines that the number of times the misfeeding is repeated has reached the specified number (step S11: YES), the controller 8 drives the processing to proceed to step S7.

When the controller 8 determines in steps S2, S5, and S10 that no misfeeding has occurred (steps S2, S5, and S10: NO), the controller 8 determines in step S12 whether or not the jam has occurred. When controller 8 determines that the jam has occurred (step S12: YES), the controller 8 drives the processing to proceed to step S7.

When the controller 8 determines that no jam has occurred (step S12: NO), the controller 8 determines in step S13 whether or not the feeding of the specified number of sheets to be printed is completed.

When the controller 8 determines that the feeding of the specified number of sheets to be printed is not completed (step S13: NO), the controller 8 is determines in step S14 whether or not it is the next paper feeding timing in the paper feeding schedule.

When the controller 8 determines that it is not the next paper feeding timing (step S14: NO), the controller 8 repeats step S14. When the controller 8 determines it is the next paper feeding timing (step S14: YES), the controller 8 drives the processing to return to step S1.

When the controller 8 determines in step S13 that the feeding of the specified number of sheets to be printed is completed (step S13: YES), the controller 8 terminates the feeding operation.

Figure 6:
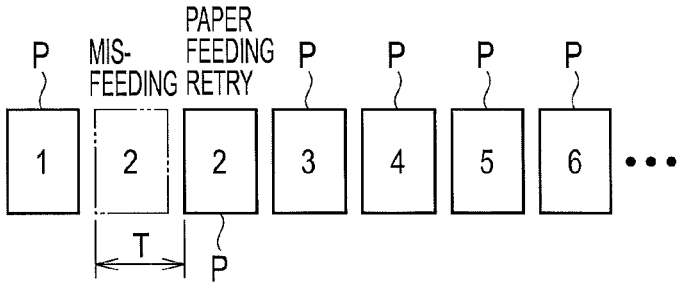
FIG. 6 is an explanatory view of paper feeding retry in the simplex printing.

For example, as shown in FIG. 6, when the misfeeding occurs in the paper feeding of the second sheet, the processing of the flowchart of FIG. 5 described above causes the paper feeding retry to be performed at the paper feeding timing of the third sheet.

Next, operations of the printer 1 in the duplex printing are described.

In the duplex printing, the controller 8 controls the paper feeding unit 2 such that the paper feeding unit 2 feeds the sheets P, based on the paper feeding schedule for duplex printing. Specifically, the controller 8 drives the paper feeding unit 2 to feed the sheets P at a cycle of 2T. The fed sheets P are subjected to front side printing by the inkjet head unit 25 while being conveyed by the belt conveying unit 23 in the printing unit 3. The sheets P subjected to the front side printing are conveyed by the upward conveying rollers 31 and the horizontal conveying rollers 33 in the circulation conveying unit 4, and are turned over by the switchback rollers 35. The turned-over sheets P are refed to the printing unit 3 by the paper refeeding rollers 38. In this case, the controller 8 controls the drive of the paper refeeding rollers 38 such that the sheets P refed by the paper refeeding rollers 38 are conveyed to the printing unit 3 alternately with the sheets P fed by the paper feeding unit 2, at the cycle of print time T based on the paper feeding schedule for duplex printing.

Figure 7:
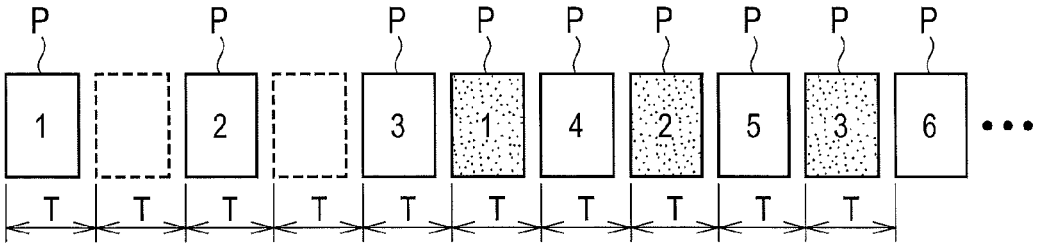
FIG. 7 is an explanatory view of a paper feeding schedule in duplex printing.

The paper feeding by the paper feeding unit 2 and the paper refeeding by the paper refeeding unit 5 is performed, for example, in the order and at the timings shown in FIG. 7, by the aforementioned paper feeding schedule for duplex printing which specifies the paper feeding timings and paper refeeding timing. In FIG. 7, the sheets P shaded by dots are sheets refed with the back sides facing upward.

In the example of FIG. 7, after the paper feeding of the third sheet, the paper feeding by the paper feeding unit 2 and the paper refeeding by the paper refeeding unit 5 are performed alternately at the cycle of print time T. However, after the paper feeding from the paper feeding unit 2 is completed in a final stage of the printing, the paper refeeding of three sheets is continuously performed at the cycle of 2T. Note that how many sheets P are fed from the paper feeding unit 2 before the first sheet is refed varies depending on the sheet size.

Figure 8:
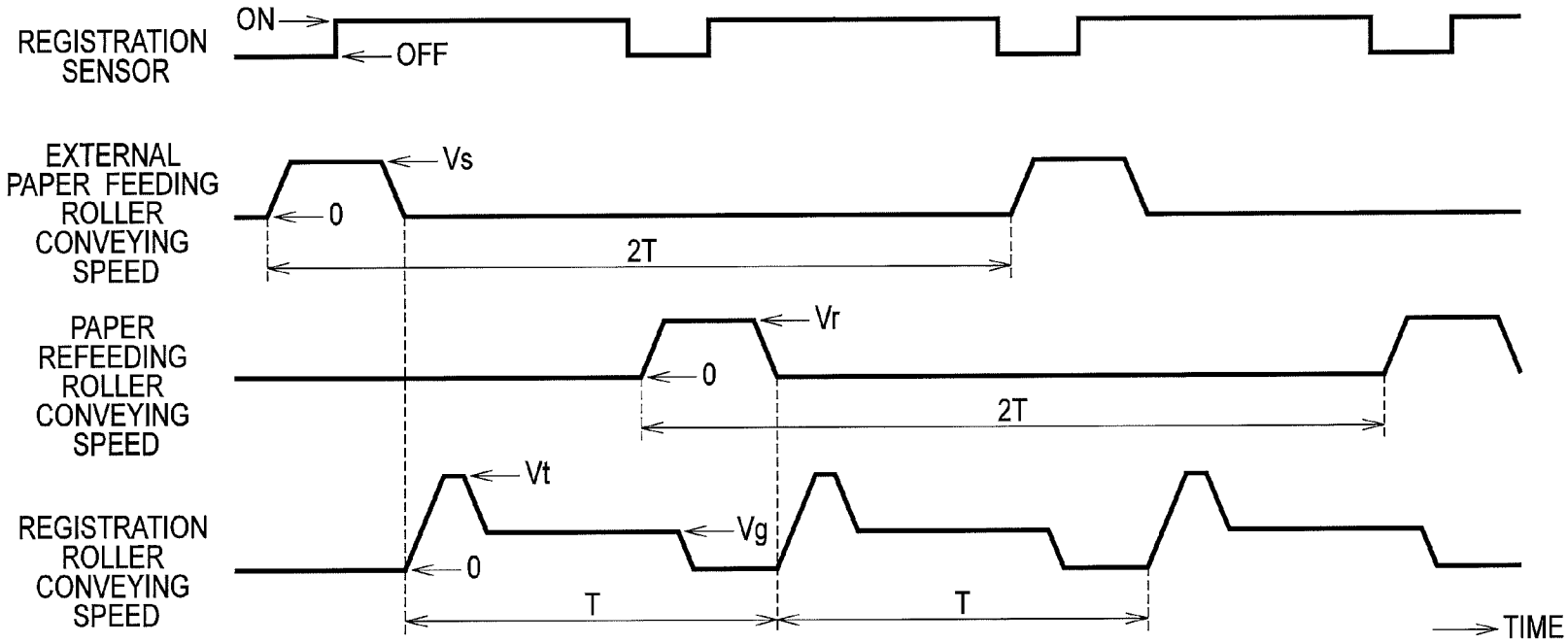
FIG. 8 is an explanatory view of operations of the external paper feeding rollers, paper refeeding rollers, and the registration rollers in duplex printing in which the sheets are fed from the external paper feed tray.

When the duplex printing is performed by feeding the sheets from the external paper feed tray 11, the external paper feeding rollers 12, the paper refeeding rollers 38, and the registration rollers 21 are controlled to be driven as in FIG. 8.

As shown in FIG. 8, in the period in which the paper feeding from the paper feeding unit 2 and the paper refeeding from the paper refeeding unit 5 are performed alternately, the registration rollers 21 operate at the cycle of print time T as in the simplex printing. The pair of external paper feeding rollers 12 and the pair paper refeeding rollers 38 each operate at the cycle of 2T.

Operations of the external paper feeding rollers 12 and the registration rollers 21 for one sheet are the same as the operations thereof in the simplex printing described above. When reaching a predetermined conveying speed Vr after the activation, the paper refeeding rollers 38 maintain the conveying speed Vr for a predetermined time and then stop. In the drive period, the paper refeeding rollers 38 receive the sheet P, convey the sheet P to the registration rollers 21, and cause the sheet P to abut on the registration rollers 21 to form a predetermined amount of sag.

Paper feeding operations by the paper feeding unit 2 including the measures taken when the misfeeding occurs in the duplex printing are the same as the paper feeding operations in the simplex printing described in the flowchart of FIG. 5.

However, since the paper feeding timing by the paper feeding unit 2 comes at a cycle of 2T in the duplex printing, the next paper feeding timing being a timing for performing the paper feeding retry when the misfeeding occurs after the paper feeding of any of the second and subsequent sheets comes a time 2T later.

Figure 9:
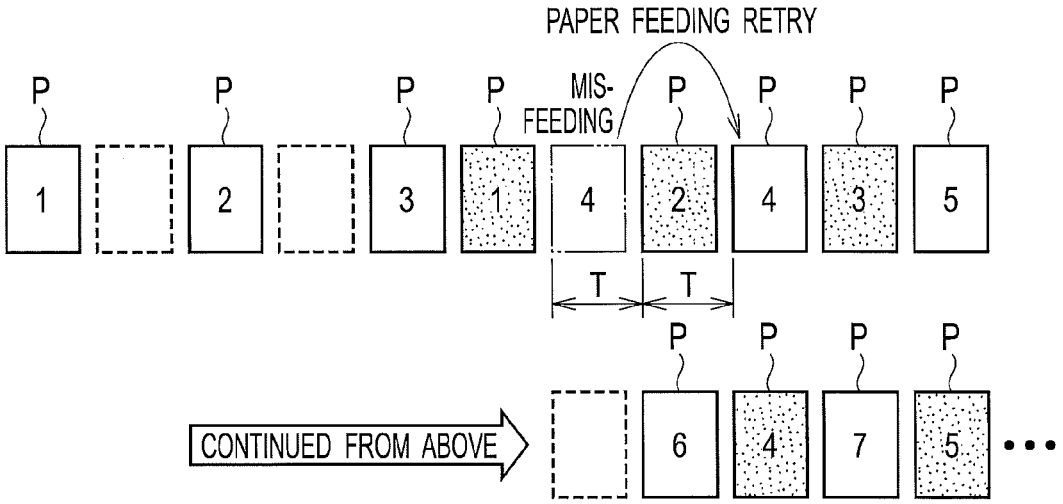
FIG. 9 is an explanatory view of the paper feeding retry in the duplex printing in the first embodiment.
Figure 10:
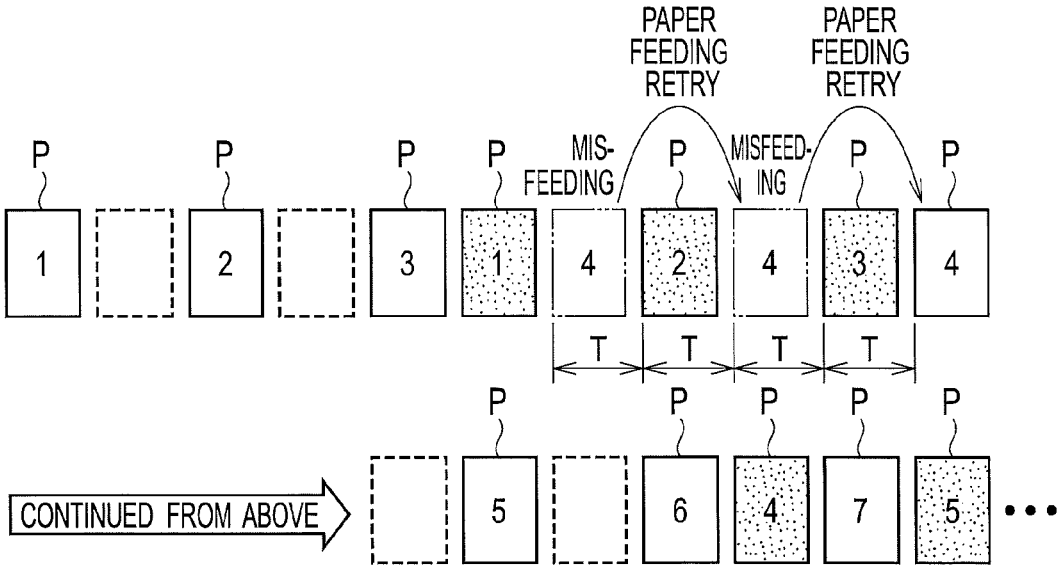
FIG. 10 is an explanatory view of repeating of the paper feed retry in the duplex printing in the first embodiment.

For example, when the misfeeding occurs in the paper feeding of the fourth sheet in the paper feeding schedule of FIG. 7, the paper feeding retry is performed at the paper feeding timing a time 2T later as shown in FIG. 9. Moreover, when the misfeeding occurs in this paper feeding retry, the repeated paper feeding retry is performed at the paper feeding timing another time 2T later as shown in FIG. 10.

In the first embodiment, when the paper feeding retry is performed in the duplex printing, the page printing order changes. For example, when the sheets are fed as in the paper feeding schedule of FIG. 7 without the misfeeding, the front side of the fourth sheet is printed and then the back side of the second sheet is printed. Meanwhile, when the fourth sheet is fed by the paper feeding retry as in FIG. 9, the back side of the second sheet is printed and then the front side of the fourth sheet is printed. Moreover, when the fourth sheet is fed in the second paper feeding retry as in FIG. 10, the back side of the second sheet is printed, then the back side of the third sheet is printed, and thereafter the front side of the fourth sheet is printed. Accordingly, when the paper feeding retry is performed in the duplex printing, the controller 8 performs printing with the order of pieces of image data being rearranged according to the changes in the page printing order due to the paper feeding retry.

As described above, in the first embodiment, when the misfeeding occurs in the paper feeding of any of the second and subsequent sheets, the controller 8 performs the paper feeding retry at the next paper feeding timing in the paper feeding schedule. Due to this, the paper feeding retry can be performed not to overlap the paper refeeding by the paper refeeding unit 5 in the duplex printing. Moreover, when the paper feeding is achieved in the paper feeding retry, stopping of the printer 1 due to jam is unnecessary. Accordingly, the work of jam release and error clearing due to misfeeding is reduced, and the usability for the user is improved. Moreover, since the occurrence of downtime due to stopping of the printer 1 is reduced, a decrease in the productivity of printed matters can be suppressed.

Accordingly, in the first embodiment, in the printer 1 configured to manage the schedule of the paper feeding timings and the paper refeeding timings in the duplex printing, the frequency of the printer 1 being stopped due to occurrence of the misfeeding can be reduced, thereby improving the usability for the user and suppressing the decrease in the productivity of printed matters.

Moreover, when the misfeeding of the sheet P occurs in the paper feeding retry by the paper feeding unit 2, the controller 8 repeatedly performs the paper feeding retry. When the number of times the misfeeding is repeated reaches the specified number, the controller 8 determines that the jam error has occurred and terminates the paper feeding. This can increase an opportunity in which the misfeeding is solved by the paper feeding retry and the paper feeding is resumed, while suppressing unnecessary repeating of the paper feeding retry.

Note that the printer 1 may be configured as follows. When the paper feeding retry is performed due to occurrence of the misfeeding in the paper feeding of any of the second and subsequent sheets in the duplex printing in which the sheets are fed from the first to third internal paper feed trays 13A to 13C, before the sheet P is sent out to the printing unit 3 by the intermediate conveying rollers 16, the sheet P taken out from one of the first to third internal paper feed trays 13A to 13C by a corresponding one of pairs of the first to third internal paper feeding rollers 14A to 14C is kept waiting at the intermediate conveying rollers 16.

Specifically, when the misfeeding occurs in the paper feeding of any of the second and subsequent sheets, the controller 8 drives one of pairs of the first to third internal paper feeding rollers 14A to 14C to pick up the sheet P from the corresponding first to third internal paper feed trays 13A to 13C in a period before the next paper feeding timing. Then, the controller 8 stops the sheet P with the leading edge portion thereof being nipped by the intermediate conveying rollers 16. Thereafter, the controller 8 drives the intermediate conveying rollers 16 such that the intermediate conveying rollers 16 feed the sheet P to the printing unit 3 at a paper feeding timing for performing the paper feeding retry. This enables adjustment of the paper feeding timing in the paper feeding retry, only by using the intermediate conveying rollers 16. Accordingly, shifting of the paper feeding timing can be suppressed.

Second Embodiment

Next, description is given of a second embodiment in which measures taken when misfeeding occurs in duplex printing is changed from those of the first embodiment.

Figure 11:
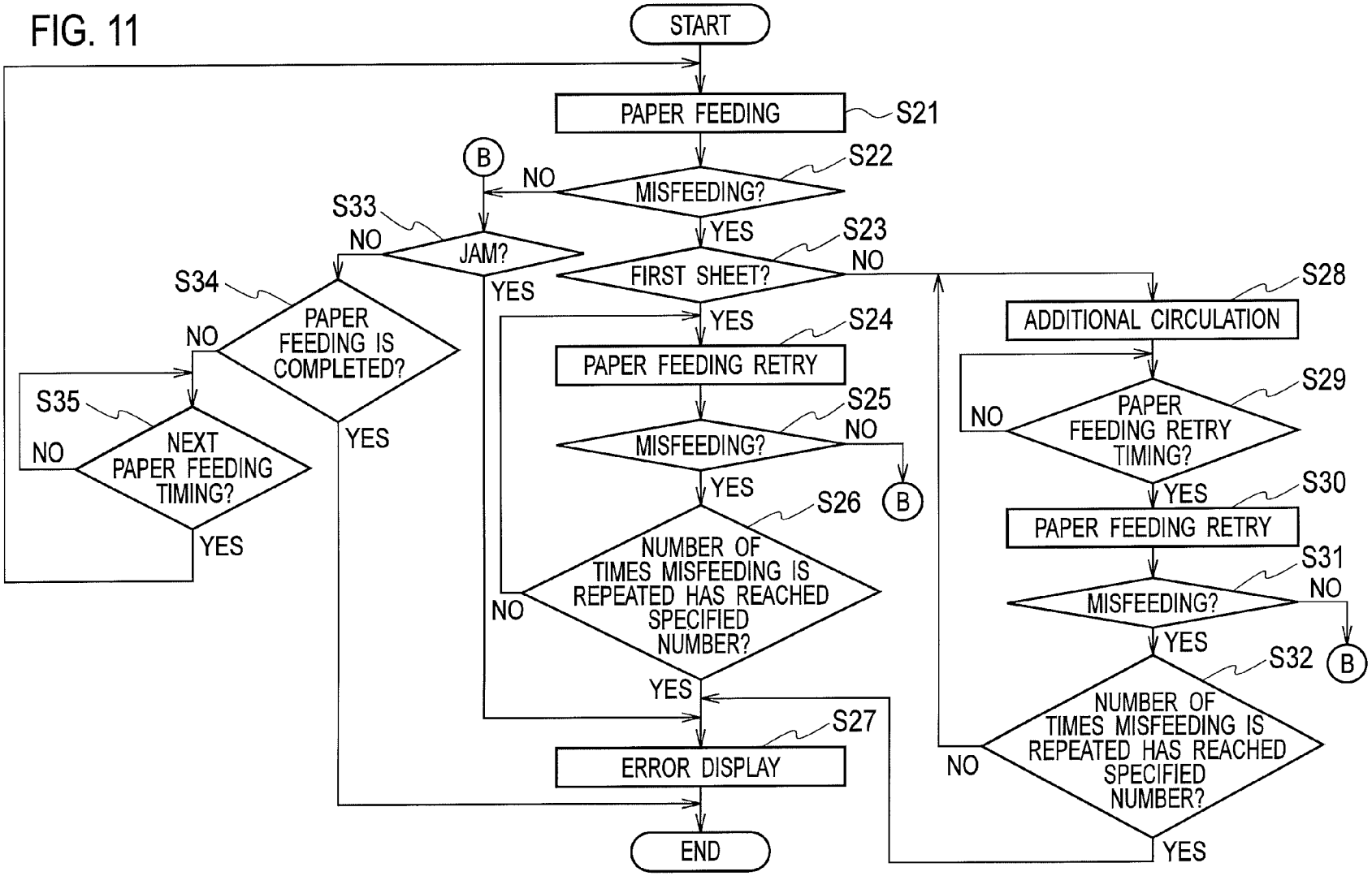
FIG. 11 is a flowchart for explaining a paper feeding operation by the paper feeding unit in a second embodiment.

FIG. 11 is a flowchart for explaining a paper feeding operation by the paper feeding unit 2 in the duplex printing in the second embodiment. Processing of the flowchart of FIG. 11 starts when an instruction of print start is given.

Processing in steps S21 to S27 of FIG. 11 is the same as the processing in step S1 to S7 of FIG. 5 described above When the controller 8 determines in step S23 that the current paper feeding in which the misfeeding has occurred is the paper feeding of any of the second and subsequent sheets (step S23: NO), in step S28, the controller 8 performs additional circulation of the sheet P which has been already fed but has not been refed for the back side printing by this time point.

Specifically, after the sheet P which has been already fed but has been not refed for the back side printing is refed to the printing unit 3 by the paper refeeding unit 5, the controller 8 performs control such that sheet P is conveyed to the circulation conveying unit 4 without being subjected to the back side printing in the printing unit 3. Then, the controller 8 performs control such that the circulation conveying unit 4 conveys and turns over the sheet P and the paper refeeding unit 5 refeeds the sheet P to the printing unit 3.

The sheet P which has been already fed but has not been refed for the back side printing by the time point when the misfeeding occurs is thus conveyed to be additionally circulated one more time and then refed. As a result, the paper sheet P is conveyed to the printing unit 3 with the printed surface facing upward. In this case, the controller 8 drives the refeeding of the sheet after the additional circulation with the front side facing upward to be performed at the paper feeding timing of the paper feeding unit 2 in the paper feeding schedule.

Note that the sheet P which has been already subjected to the back side printing at the time point when the misfeeding occurs is delivered without being additionally circulated. Moreover, even if the back side printing of the sheet P which has been already refed for the back side printing is not completed at the time point when the misfeeding occurs, this sheet P is subjected to the back side printing and is delivered.

Next, in step S29, the controller 8 determines whether or not it is a paper feeding retry timing. The paper feeding retry timing is a paper feeding timing subsequent to a paper feeding timing of the sheet P which is additionally circulated and refed last. When the controller 8 determines that it is not the paper feeding retry timing (step S29: NO), the controller 8 repeats step S29.

When the controller 8 determines that it is the paper feeding retry timing (step S29: YES), the controller 8 performs the paper feeding retry in step S30.

Next, in step S31, the controller 8 determines whether or not the misfeeding has occurred in the paper feeding retry.

When the controller 8 determines that the misfeeding has occurred (step S31: YES), the controller 8 determines in step S32 whether or not the number of times the misfeeding is repeated has reached a specified number.

When determining that the number of times the misfeeding is repeated has not reached the specified number (step S32: NO), the controller 8 drives the processing to return to step S28 and performs additional circulation of the sheet P which has been already fed but has not been refed for the back side printing. In this case, the paper refeeding before and after the additional circulation is not the paper refeeding for the back side printing. Accordingly, when the misfeeding occurs in the paper feeding retry, the additional circulation of the sheet P which has been already fed but has not been refed for the back side printing by the time point when the first misfeeding occurs is repeated.

When the controller 8 determines that the number of times the misfeeding is repeated has reached the specified number (step S32: YES), the controller 8 drives the processing to proceed to step S27.

When the controller 8 determines in steps S22, S25, and S31 that no misfeeding has occurred (step S22, S25, S31: NO), the controller 8 drives the processing to proceed to step S33. Processing in steps S33 to S35 are the same as the processing in steps S12 to S14 of FIG. 5 described above.

Figure 12:
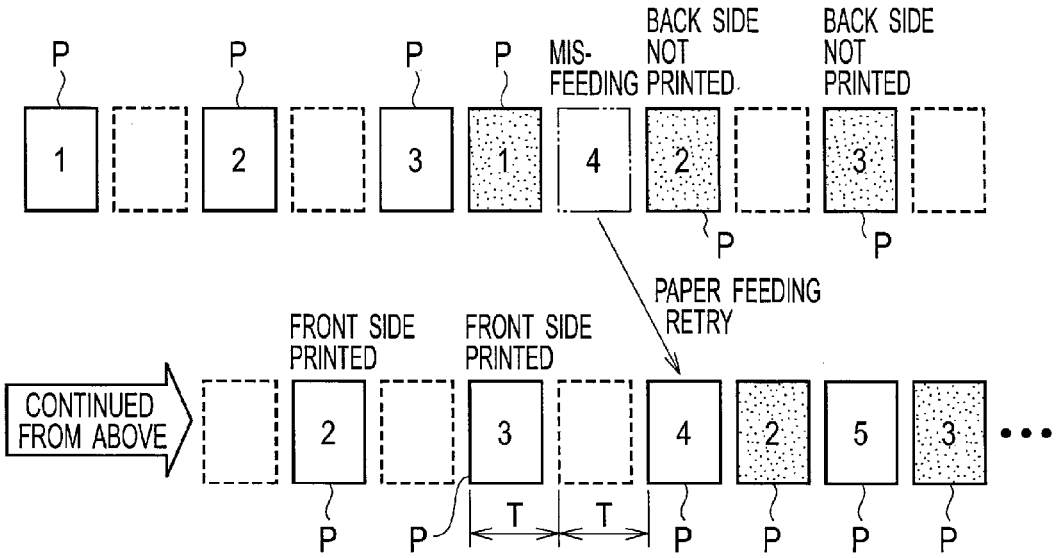
FIG. 12 is an explanatory view of the paper feeding retry in the duplex printing in the second embodiment.

For example, as shown in FIG. 12, when the misfeeding occurs in the paper feeding of the fourth sheet in the case where the duplex printing is performed at the paper feeding schedule of FIG. 7, the processing of the flowchart of FIG. 11 described above causes the second and third sheets P which have been already fed but are not refed for the back side printing at this time point to be additionally circulated.

In other words, the second and third sheets P are refed after the occurrence of misfeeding of the fourth sheet P and then circularly conveyed without being subjected to the back side printing. The second and third sheets P are thereby turned over and refed with the printed front side facing upward. Note that the first sheet P is already refed for the back side printing at the time point when the misfeeding of the fourth sheet P occurs. Accordingly, the first sheet P is subjected to the back side printing and delivered.

In this case, the paper refeeding timings of the second and third sheets P after the additional circulation are paper feeding timings of the paper feeding unit 2 in the paper feeding schedule. Specifically, the white second and third sheets P in a second row of FIG. 12 are refed after the additional circulation with the printed surfaces facing upward, and this paper refeeding is performed at the paper feeding timings of the paper feeding unit 2 in the paper feeding schedule.

Then, the paper feeding retry of the fourth sheet is performed at a paper feeding timing subsequent to the paper feeding timing of the third sheet P which is the sheet P additionally circulated and refed last. Specifically, the paper feeding retry of the fourth sheet is performed a time 2T after the timing of the paper refeeding of the third sheet P after the additional circulation. When the paper feeding is successful in this paper feeding retry, as shown in FIG. 12, the paper feeding and the paper refeeding of the sheets P is performed as in FIG. 7 thereafter. Then, the sheets P are printed.

The printing is thereby performed in the same page order as that in the case where the paper feeding is performed as in the paper feeding schedule of FIG. 7 without misfeeding.

Figure 13:
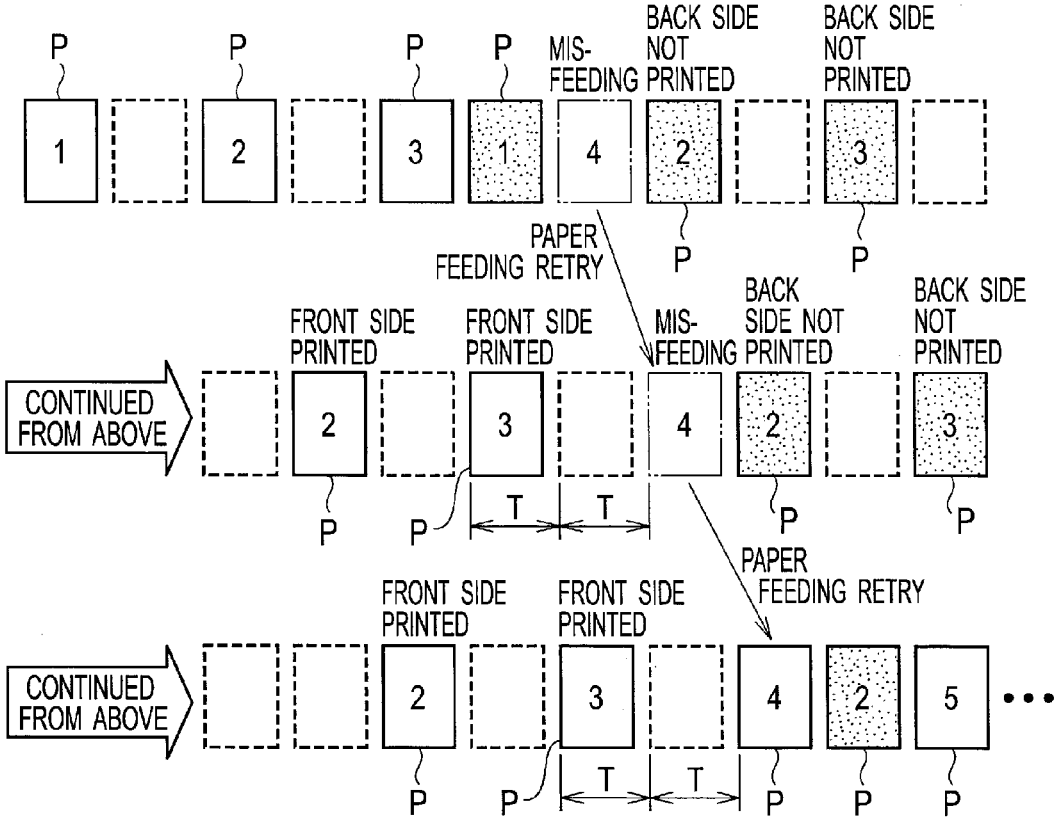
FIG. 13 is an explanatory view of repeating of the paper feeding retry in the duplex printing in the second embodiment.

When the misfeeding occurs in the paper feeding retry, the additional circulation of the second and third sheets P and the paper feeding retry of the fourth sheet is repeated as shown in FIG. 13.

As described above, in the second embodiment, when the misfeeding occurs in the paper feeding of any of the second and subsequent sheets, the controller 8 performs control such that the sheet P which has already been fed but has been not refed for the back side printing by the time point of the misfeeding is refed, then conveyed while being turned over by the circulation conveying unit 4 without being subjected to the back side printing, and refed by the paper refeeding unit 5 at the paper feeding timing of the paper feeding unit 2 in the paper feeding schedule. Then, the controller 8 performs control such that the paper feeding unit 2 performs the paper feeding retry at the paper feeding timing subsequent to the paper feeding timing of the sheet P refed last.

This can reduce the frequency of the printer 1 being stopped due to occurrence of the misfeeding, thereby improving the usability for the user and suppressing the decrease in the productivity of printed matters as in the first embodiment, while maintaining the page printing order.

As described above, in the first embodiment, when the paper feeding retry is performed in the duplex printing, the page printing order changes. Accordingly, the printing is performed with the order of pieces of images data being rearranged according to this change. This increases the processing load of the controller 8. Moreover, the processing of rearranging the order of pieces of image data may be too late for the printing.

Meanwhile, in the second embodiment, since the page printing order can be maintained, there is no need to rearrange the order of pieces of image data.

Note that, as in the first embodiment, the printer 1 may be configured as follows also in the second embodiment. When the paper feeding retry is performed due to occurrence of the misfeeding in the paper feeding of any of the second and subsequent sheets in the duplex printing in which the sheets are fed from the first to third internal paper feed trays 13A to 13C, before the sheet P is sent out to the printing unit 3 by the intermediate conveying rollers 16, the sheet P taken out from one of the first to third internal paper feed trays 13A to 13C by a corresponding one pair of the first to third internal paper feeding rollers 14A to 14C is kept waiting at the intermediate conveying rollers 16.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printer comprising:

a printing unit configured to perform printing while conveying a sheet;

a paper feeding unit configured to feed the sheet to the printing unit;

a circulation conveying unit including a route and configured to convey the sheet sent out from the printing unit along the route, the route including a switchback route for turning over the sheet;

a paper refeeding unit configured to refeed the sheet turned over in the switchback route to the printing unit; and a controller configured to control a paper feeding by the paper feeding unit and a paper refeeding by the paper refeeding unit based on a paper feeding schedule for duplex printing which specifies paper feeding timings by the paper feeding unit and paper refeeding timings by the paper refeeding unit for a case other than a misfeeding of any of second and subsequent sheets in the paper feeding by the paper feeding unit such that the sheet refed from the paper refeeding unit and the sheet fed from the paper feeding unit are alternately conveyed to the printing unit, wherein, upon the misfeeding of any of the second and subsequent sheets in the paper feeding by the paper feeding unit during the duplex printing, the controller drives the paper feeding unit to perform a paper feeding retry at one or more of the paper feeding timings in the paper feeding schedule for duplex printing.

2. The printer according to claim 1, wherein, upon the misfeeding of any of the second and subsequent sheets in the paper feeding by the paper feeding unit during the duplex printing, the controller:

drives the paper refeeding unit to refeed the sheet which has been already fed by the paper feeding unit and has not been refed for back side printing by the paper refeeding unit by a time point of the misfeeding;

drives the circulation conveying unit to convey and turn over the refed sheet without the back side printing being performed;

drives the paper refeeding unit to perform the paper refeeding at the paper feeding timing in the paper feeding schedule for duplex printing; and drives the paper feeding unit to perform the paper feeding retry at the paper feeding timing subsequent to the paper feeding timing of the sheet refed last.

3. The printer according to claim 2, wherein, upon a misfeeding of the sheet in the paper feeding retry by the paper feeding unit, the controller drives the paper feeding unit to repeat the paper feeding retry every paper feeding timing and stop performing the paper feeding retry when a number of times the misfeeding is repeated reaches a specified number.

4. The printer according to claim 2, wherein the paper feeding unit comprises:

a paper feeding roller configured to pick up the sheet from a paper feed tray; and an intermediate conveying roller configured to send out the sheet picked up from the paper feed tray by the paper feeding roller to the printing unit, and wherein, in the paper feeding retry of any of the second and subsequent sheets by the paper feeding unit, the controller drives the paper feeding unit to keep the sheet picked up from the paper feed tray by the paper feeding roller waiting at the intermediate roller and then send the sheet to the printing unit by the intermediate conveying roller.

5. The printer according to claim 1, wherein, upon a misfeeding of the sheet in the paper feeding retry by the paper feeding unit, the controller drives the paper feeding unit to repeat the paper feeding retry every paper feeding timing and stop performing the paper feeding retry when a number of times the misfeeding is repeated reaches a specified number.

6. The printer according to claim 5, wherein the paper feeding unit comprises:

a paper feeding roller configured to pick up the sheet from a paper feed tray; and an intermediate conveying roller configured to send out the sheet picked up from the paper feed tray by the paper feeding roller to the printing unit, and wherein, in the paper feeding retry of any of the second and subsequent sheets by the paper feeding unit, the controller drives the paper feeding unit to keep the sheet picked up from the paper feed tray by the paper feeding roller waiting at the intermediate roller and then send the sheet to the printing unit by the intermediate conveying roller.

7. The printer according to claim 1, wherein the paper feeding unit comprises:

a paper feeding roller configured to pick up the sheet from a paper feed tray; and an intermediate conveying roller configured to send out the sheet picked up from the paper feed tray by the paper feeding roller to the printing unit, and wherein, in the paper feeding retry of any of the second and subsequent sheets by the paper feeding unit, the controller drives the paper feeding unit to keep the sheet picked up from the paper feed tray by the paper feeding roller waiting at the intermediate roller and then send the sheet to the printing unit by the intermediate conveying roller.

8. The printer according to claim 1, wherein, upon the misfeeding of any of the second and subsequent sheets in the paper feeding by the paper feeding unit during the duplex printing, the controller drives the paper feeding unit to perform the paper feeding retry at the paper feeding timing subsequent to the paper feeding timing at an occurrence of the misfeeding in the paper feeding schedule for duplex printing.

9. The printer according to claim 1, wherein the printing unit comprises an inkjet head, the paper feeding unit comprises a first roller, and the paper refeeding unit comprises a second roller.

* * * * *